US006955349B2

(12) United States Patent
Watase

(10) Patent No.: US 6,955,349 B2
(45) Date of Patent: Oct. 18, 2005

(54) RECORDING MEDIUM CONVEYING DEVICE AND IMAGE FORMING APPARATUS INCLUDING THE SAME

(75) Inventor: Hiroyuki Watase, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 264 days.

(21) Appl. No.: 10/347,633

(22) Filed: Jan. 22, 2003

(65) Prior Publication Data

US 2003/0151191 A1 Aug. 14, 2003

(30) Foreign Application Priority Data

Jan. 24, 2002 (JP) ..... 2002-015508
Aug. 1, 2002 (JP) ..... 2002-224899
Nov. 25, 2002 (JP) ..... 2002-340371

(51) Int. Cl.[7] ..... B65H 9/04
(52) U.S. Cl. ..... 271/242
(58) Field of Search ..... 271/242

(56) References Cited

U.S. PATENT DOCUMENTS 5,358,235 A * 10/1994 Konno et al. ..... 271/227
5,765,825 A 6/1998 Watase
6,356,735 B1 * 3/2002 Hozumi ..... 399/395
2003/0085505 A1 * 5/2003 Inoue et al. ..... 271/10.01

FOREIGN PATENT DOCUMENTS

| | | |
|---|---|---|
| JP | 58-174965 | 10/1983 |
| JP | 5-278904 | 10/1993 |
| JP | 7-267434 | 10/1995 |
| JP | 8-91637 | 4/1996 |
| JP | 2001-39547 | 2/2001 |

* cited by examiner

*Primary Examiner*—Donald P. Walsh
*Assistant Examiner*—Kenneth W. Bower
(74) *Attorney, Agent, or Firm*—Oblon, Spivak, McClelland, Maier & Neustadt, P.C.

(57) ABSTRACT

A recording medium conveying device for an image forming apparatus of the present invention includes a conveying member for conveying a sheet or similar recording medium by nipping it. After the sheet being conveyed by the conveying member has abutted against a registering member, the registering member rotates in synchronism with the rotation of an image carrier carrying an image thereon for thereby conveying the recording medium toward an image transfer position. After the recording medium has slackened on abutting against the registering member, a nip canceling mechanism cancels the nip of the conveying member acting on the recording medium.

25 Claims, 5 Drawing Sheets

RECORDING MEDIUM CONVEYING DEVICE AND IMAGE FORMING APPARATUS INCLUDING THE SAME

BACKGROUND OF THE INVENTION

1. Field of the Invention

The present invention relates to a copier, printer, facsimile apparatus or similar image forming apparatus for forming an image on a paper sheet, OHP (OverHead Projector) film, intermediate image transfer body or similar recording medium and more particularly to a device included in the image forming apparatus for conveying the recording medium.

2. Description of the Background Art

Generally, in a recording medium conveying device included in an image forming apparatus, a sheet or similar recording medium is fed from a sheet cassette and conveyed along a preselected path. A roller pair nips the sheet fed from the sheet cassette and conveys it along the above path toward a registration roller pair. The registration roller pair once stops the sheet and then conveys it toward an image transfer station in synchronism with the rotation of an image carrier carrying a toner image thereon. At the image transfer station, the toner image is transferred from the image carrier to the sheet.

A problem with the conventional recording medium conveying device is that when, e.g., sheets are stacked on the sheet cassette in an inclined position, the sheet fed from the sheet cassette is apt to skew. It is a common practice to correct the skew of the sheet by causing the sheet to abut against the registration roller pair 2 and slacken.

Today, considering the increasing demand for the compact configuration of an image forming apparatus, it is difficult to provide a distance great enough for the sheet to sufficiently slacken on a path between the roller pair and the registration roller pair. However, if the distance between the roller pair and the registration roller pair and therefore the space available for the sheet to slacken is reduced, then heavy stress acts on the sheet and shifts it in, e.g., the widthwise direction. This brings about color shift in a color mode or brings about the bend of a straight line in a monochrome mode.

Japanese Paten Laid-Open Publication Nos. 7-261572 and 7-261573 each disclose a recording medium conveying device in which a pickup roller pays out sheets from a sheet cassette while a feed roller and a reverse roller cooperate to separate the top sheet from the underlying sheets. The sheet thus fed from the sheet cassette is conveyed by consecutive roller pairs until the leading edge of the sheet abuts against a registration roller pair, which is in a halt. Subsequently, the registration roller pair is rotated in synchronism with the rotation of a photoconductive drum carrying a toner image thereon, conveying the sheet. At this instant, an adhesion roller and an adhesion charger, which is disposed in the image transfer drum, cooperate to wrap the sheet around the drum being rotated. At a position short of an image transfer position, nip canceling means associated with the registration roller pair and roller pairs for conveyance is operated to cancel the nip acting on the sheet. The sheet is then brought to the image transfer position by the further rotation of the image transfer drum.

As stated above, the nip canceling means is associated with the registration roller pair, which conveys the sheet toward the image transfer position at preselected or reference timing, and cancels the nip of the roller pair. This, however, brings about a problem that the reference timing varies every time the nip of the registration roller is canceled, preventing the toner image from being transferred to the sheet with stable quality. Further, the charger and roller for adhesion increase the number of parts and overall size of the conveying device.

Technologies relating to the present invention are also disclosed in, e.g., Japanese Patent Laid-Open Publication No. 8-91637.

SUMMARY OF THE INVENTION

It is a first object of the present invention to provide a recording medium conveying device capable of insuring high image quality by causing a recording medium to slacken for the removal of skew while obviating stress ascribable to the slackening, and reducing the number of parts to thereby implement a compact configuration, and an image forming apparatus including the same.

It is a second object of the present invention to provide a recording medium conveying device allowing a registering member to surely convey a recording medium free from skew to an image transfer position, and an image forming apparatus including the same.

It is a third object of the present invention to provide a recording medium conveying device capable of accurately obviating the influence of stress by accurately determining timing, and an image forming apparatus including the same.

It is a fourth object of the present invention to provide a recording medium conveying device capable of surely obviating the stress ascribable to slacking at the beginning of image transfer, and an image forming apparatus including the same.

It is a fifth object of the present invention to provide a recording medium conveying device capable of canceling nip acting on a recording medium with a simple configuration, and an image forming apparatus including the same.

It is a sixth object of the present invention to provide a recording medium conveying device capable of obviating image shift during image transfer even when a recording medium of relatively large size is used, and an image forming apparatus including the same.

It is a seventh object of the present invention to provide a recording medium conveying device capable of obviating the influence of stress in accordance with the length of a recording medium and obviating unnecessary operation of nip canceling means to thereby save power, and an image forming apparatus including the same.

It is an eighth object of the present invention to provide a recording medium conveying device configured to facilitate mounting and dismounting of the individual structural parts, and an image forming apparatus including the same.

It is a ninth object of the present invention to provide a recording medium conveying device capable of promoting the conveyance of a recording medium with a conveying member even after a nip on the recording medium has been canceled, and an image forming apparatus including the same.

A recording medium conveying device for an image forming apparatus of the present invention includes a conveying member for conveying a sheet or similar recording medium by nipping it. After the sheet being conveyed by the conveying member has abutted against a registering member, the registering member rotates in synchronism with the rotation of an image carrier carrying an image thereon for thereby conveying the recording medium toward an image transfer position. After the recording medium has slackened on abutting against the registering member, a nip canceling mechanism cancels the nip of the conveying member acting on the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
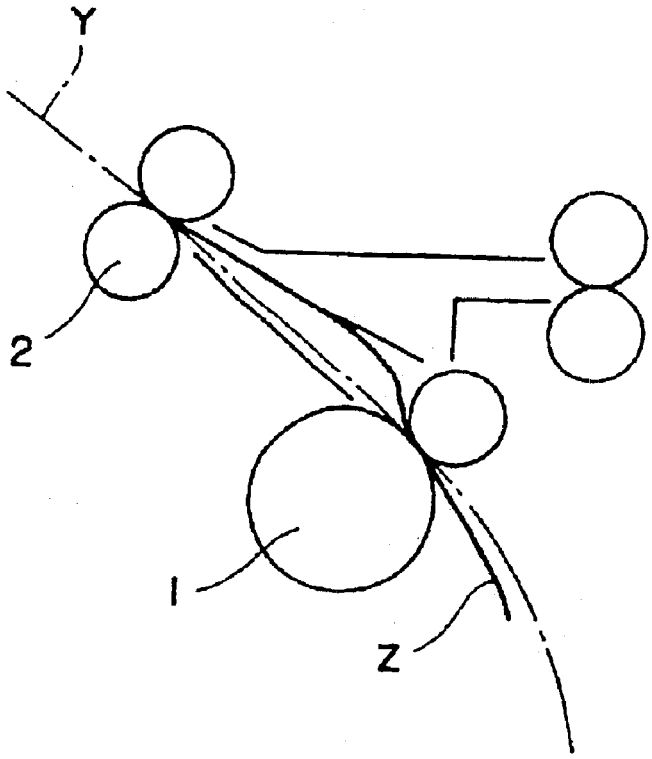
FIG. 1 PRIOR ART
FIG. 1 is a fragmentary view showing a conventional recording medium conveying device included in an image forming apparatus.

To better understand the present invention, brief reference will be made to a conventional recording medium conveying device included in a copier or similar image forming apparatus, shown in FIG. 1. As shown, the recording medium conveying device includes a roller pair or conveying member 1 and a registration roller pair or registering member 2 arranged on a path Y. A sheet or recording medium Z is fed from a sheet cassette, not shown, and conveyed along the path Y.

More specifically, the roller pair 1 nips the sheet Z fed from the sheet cassette to the path Y and conveys it along the path Y toward the registration roller pair 2. The registration roller pair 2 once stops the sheet Z and then conveys it toward an image transfer station in synchronism with the rotation of an image carrier on which a toner image is formed. At the image transfer station, the toner image is transferred from the image carrier to the sheet Z.

Figure 2:
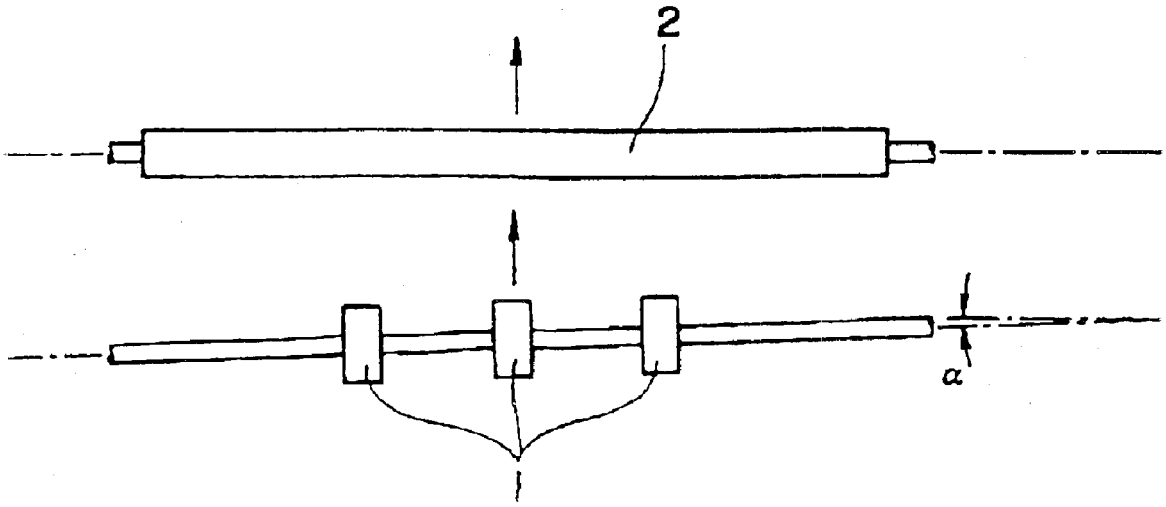
FIG. 2 PRIOR ART
FIG. 2 demonstrates a specific condition wherein a recording medium skews in the conventional recording medium conveying device.

Assume that the sheets stacked on the sheet cassette is inclined or that, as shown in FIG. 2, the roller pair 1 is inclined relative to the registration roller pair 2 by an angle $\alpha$. Then, the sheet Z is conveyed askew. To correct the skew of the sheet Z, the registration roller pair 2 once stops the sheet Z and causes it to slacken.

Today, considering the increasing demand for the compact configuration of an image forming apparatus, it is difficult to provide a distance great enough for the sheet Z to sufficiently slacken on the path Y between the roller pair 1 and the registration roller pair 2. However, if the distance between the roller pair 1 and the registration roller pair 2 and therefore the space available for the sheet Z to slacken is reduced, then heavy stress acts on the sheet Z and shifts it in, e.g., the widthwise direction. This brings about color shift in a color mode or brings about the bend of a straight line in a monochrome mode.

Figure 3:
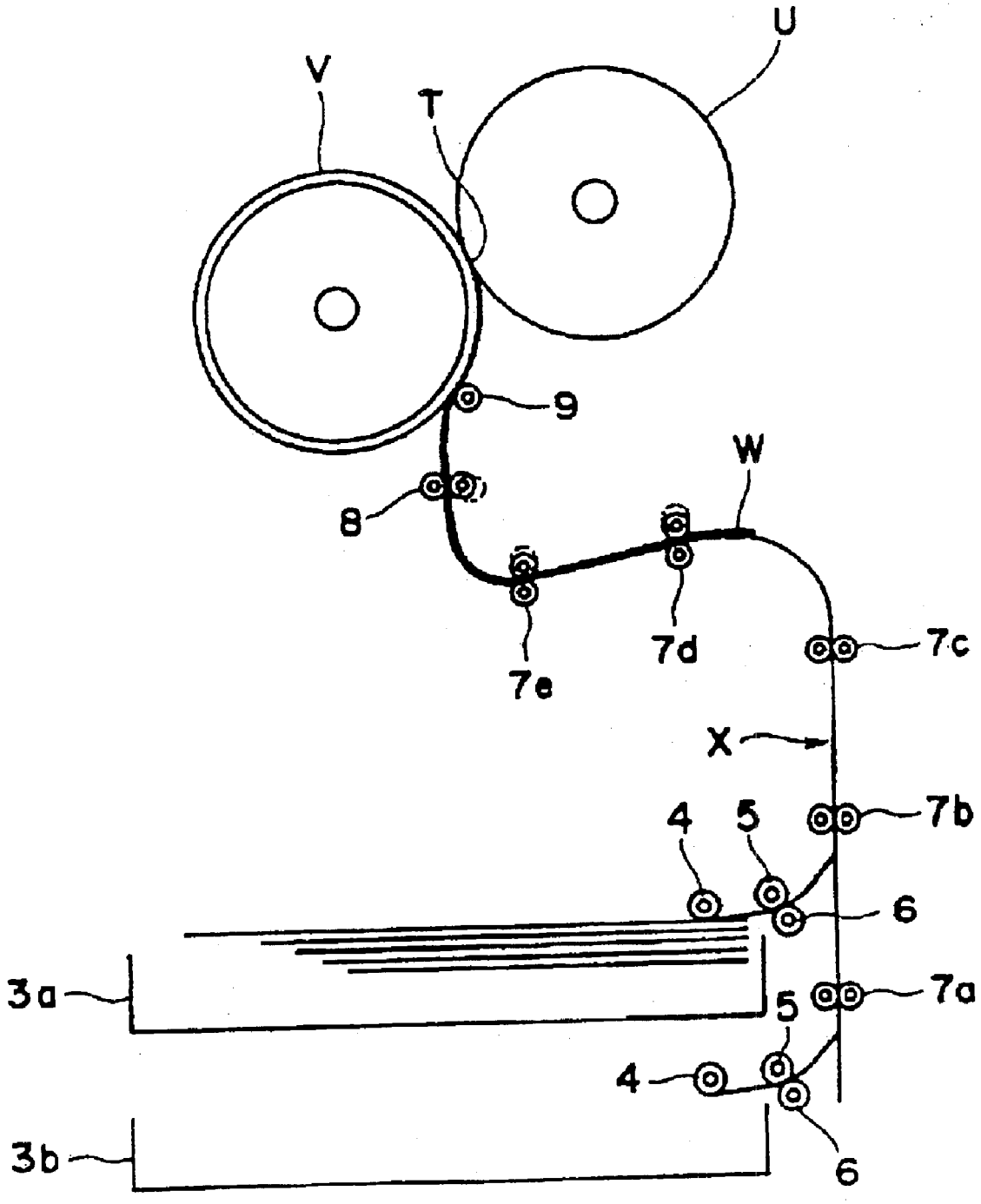
FIG. 3 PRIOR ART
FIG. 3 is a fragmentary view showing another conventional recording medium conveying device.

FIG. 3 shows another conventional recording medium conveying device taught in Laid-Open Publication Nos. 7-261572 and 7-261573 mentioned earlier. As shown, the recording medium conveying device includes a path X extending from sheet cassettes 3*a* and 3*b* to an image transfer position T between a photoconductive drum or image carrier U and an image transfer drum V. Arranged on the path X are pickup rollers 4, feed rollers 5 and reverse rollers 6 cooperating with each other, a plurality of roller pairs or conveying members 7*a*, 7*b*, 7*c*, 7*d* and 7*e*, a registration roller pair or registering member 8, and an adhesion roller 9, as named from the upstream side in the direction of sheet conveyance.

In operation, the pickup roller 4 associated with, e.g., the sheet cassette 3*a* pays out sheets W while the feed roller 5 and reverse roller 6 cooperate to separate the top sheet W from the underlying sheets W. The sheet W thus fed from the sheet cassette 3*a* is conveyed along the path X by the consecutive roller pairs 7*b*, 7*c* and 7*d* until the leading edge of the sheet W abuts against the registration roller pair 8, which is in a halt. Subsequently, the registration roller pair 8 is rotated in synchronism with the rotation of the photoconductive drum Y carrying a toner image thereon, conveying the sheet W toward the image transfer position T. At this instant, the adhesion roller 9 and an adhesion charger, not shown, disposed in the image transfer drum V cooperate to wrap the sheet W around the drum V being rotated. At a position short of the image transfer position T, nip canceling means, not shown, associated with the registration roller pair 8 and roller pairs 7*d* and 7*e* is operated to cancel the nip acting on the sheet W. The sheet W is then brought to the image transfer position T by the further rotation of the image transfer drum V.

The recording medium conveying device with the above configuration has some problems left unsolved, as stated earlier.

Figure 4:
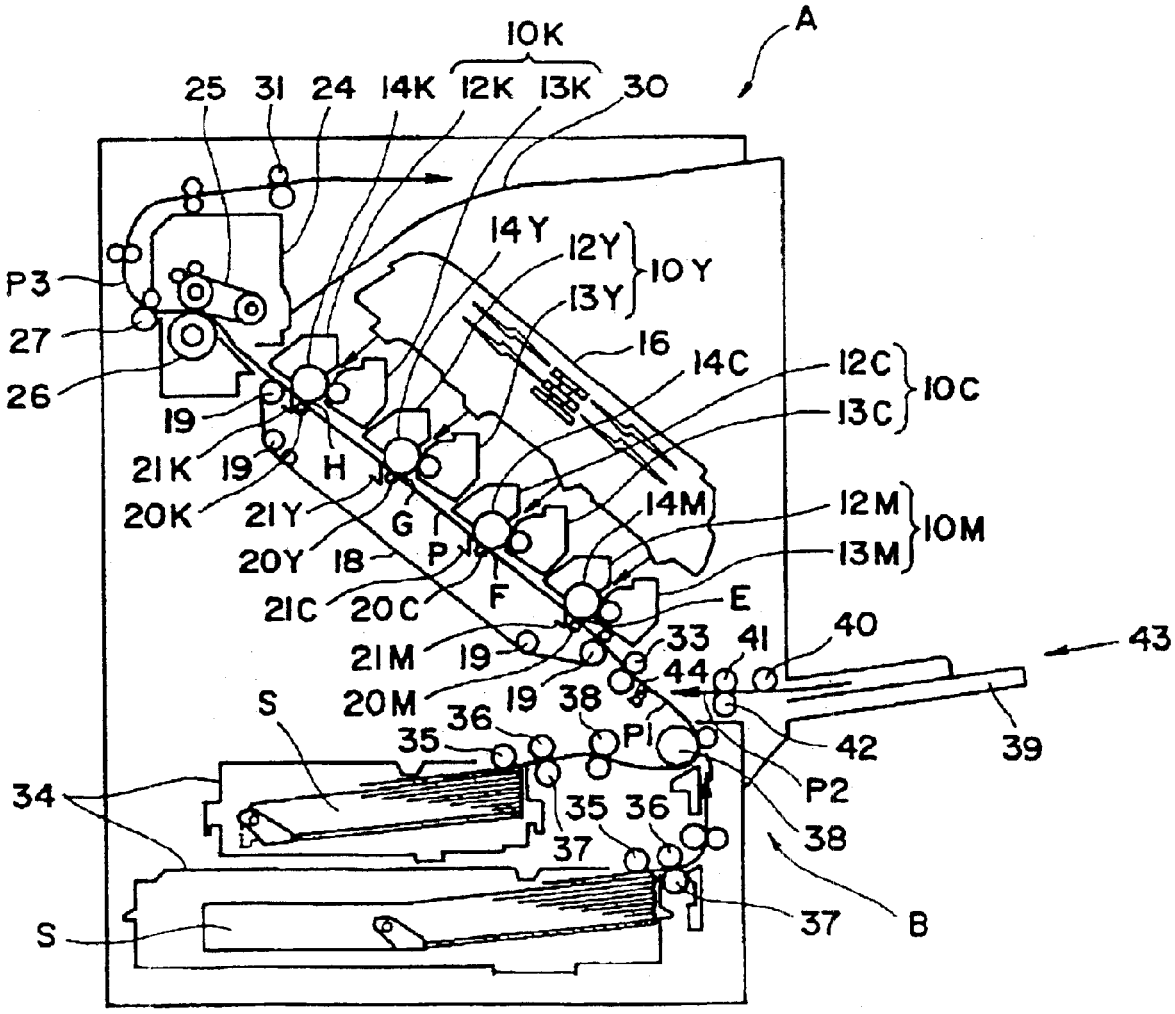
FIG. 4 is a view showing an image forming apparatus embodying the present invention.

Referring to FIG. 4, an image forming apparatus embodying the present invention is shown and implemented as a tandem, electrophotographic color copier by way of example. As shown, the color copier includes a copier body A in which a recording medium conveying device B is arranged for conveying a sheet or similar recording medium S. The recording medium conveying device B includes an inlet path P1, a manual feed path P2, a path P, and an outlet path P3, which will be described specifically later. The path P obliquely extends from the bottom right toward the top left, as viewed in FIG. 1.

A magenta (M), a cyan (C), a yellow (Y) and a black (K) image forming means 10M, 10C, 10Y and 10K are sequentially arranged on the path P from the bottom right toward the top left in a tandem configuration. The image forming means 10M, for example, includes an image carrier unit 12M and a developing unit 13M and is removably mounted to the copier body A. The image carrier unit 12M includes a photoconductive drum or image carrier 14M. Because the other image forming means 10C, 10Y and 10K are identical in configuration with the image forming means 10M, the structural elements of the former are simply distinguished by the structural elements of the latter by suffixes C, Y and K. An optical writing unit 16 is positioned above and inclined along the image forming means 10M through 10K.

An endless belt or recording medium support 18 is positioned below the image forming means 10M through 10K with the intermediary of the path P. In the illustrative embodiment, the belt 18 is passed over four rollers 19 with its upper run extending along the path P in contact with the drums 14M through 14K. A drive source, not shown, causes the belt 18 to move counterclockwise, as viewed in FIG. 4.

Image transfer rollers 20M, 20C, 20Y and 20K and image transfer brushes 21M, 21C, 21Y and 21K are arranged between the opposite runs of the belt 18 and assigned to the drums 14M, 14C, 14Y and 14K, respectively.

A registration roller pair or registering member 33 and a fixing unit 24 are positioned on the path P upstream and downstream of the belt 18, respectively. The fixing unit 24 includes an endless fixing belt 25, a press roller 26 pressed against the belt 25, and an outlet roller pair 27. The outlet path P3 contiguous with the path P extends from the outlet of the fixing unit 24 to an outlet roller pair 31. The outlet roller pair 31 on the outlet path P3 discharges the sheet S to a stack tray 30 positioned on the top of the copier body A.

Two sheet cassettes 34 are positioned below the belt 18 one above the other, and each is loaded with a stack of sheets S of a particular size. The inlet path P1 extends from the right ends of the sheet cassettes 34, as viewed in FIG. 4, for guiding the sheet S to the registration roller pair 33 positioned on the path P. Sequentially arranged on the inlet path P1 are pickup rollers 35, feed rollers 36, back rollers 37 and a plurality of roller pairs or conveying members 38, as named from the upstream side. The pickup roller 35 pays out the sheets S from one of the sheet cassette 34 associated therewith while the feed roller 36 and back roller 37 cooperate to separate the top sheet S from the underlying sheets S. The top sheet S fed from the sheet cassette 34 is conveyed by the roller pairs 38.

A manual feed section 43 includes a foldable, manual feed tray 39 mounted on the right side of the copier body A, as viewed in FIG. 4. The manual feed path P2 extends from the left end of the manual feed tray 39, as viewed in FIG. 4, to the registration roller pair 33. A pickup roller 40, a feed roller 41 and a back roller 42 are sequentially arranged on the manual feed path P2, as named from the upstream side.

A registration sensor 44 is positioned upstream of the registration roller pair 33 in the direction of sheet conveyance. The registration sensor 14 senses the leading edge of the sheet S being conveyed by the roller pair 38.

In operation, when the operator of the copier pushes a start switch, not shown, the pickup roller 35, feed roller 36 and back roller 37 assigned to one of the sheet cassettes 34 selected are driven to feed one sheet S to the inlet path P1. The roller pair 38 conveys the sheet along the inlet path P1. The sheet S is caused to abut against the registration roller pair 33 at preselected timing based on the output signal of the registration sensor 44. The registration roller pair 33 in a halt stops the sheet S to thereby cause it to slacken. This is also true with the sheet S fed from the manual feed tray 39 except that the sheet S is conveyed along the path P2 to the registration sensor 44.

On the other hand, in the image forming means 10M through 10K, the drums 14M through 14K each are rotated to form a toner image of a particular color thereon. At the same time, a drive motor, not shown, causes one of the rollers 19 to rotate for thereby moving the belt 18; the other rollers 19 are rotated by the belt 18.

The registration roller pair 33 is caused to rotate in synchronism with the rotation of the drums 14M through 14K to convey the sheet S to the path P. Subsequently, the belt 18 in movement conveys the sheet P via consecutive image transfer positions E, F, G and H between the belt 18 and the image forming means 10M through 10K, respectively. While the belt 18 is in movement, the toner images of different colors formed on the drums 14M through 14K are sequentially transferred to the sheet S one above the other by the brushes 21M through 21K at the image transfer positions E through H, completing a full-color image on the sheet S. Of course, in a bicolor mode or a monochrome mode, for example, only toner images of desired colors or a toner image of a desired color will be transferred to the sheet S.

The sheet S carrying the toner image is conveyed to the fixing unit 24 and has the toner image fixed thereby. The sheet S coming out of the fixing unit 24 is further conveyed along the outlet path P3 and then driven out to the stack tray 30 by the outlet roller pair 31.

Figure 5:
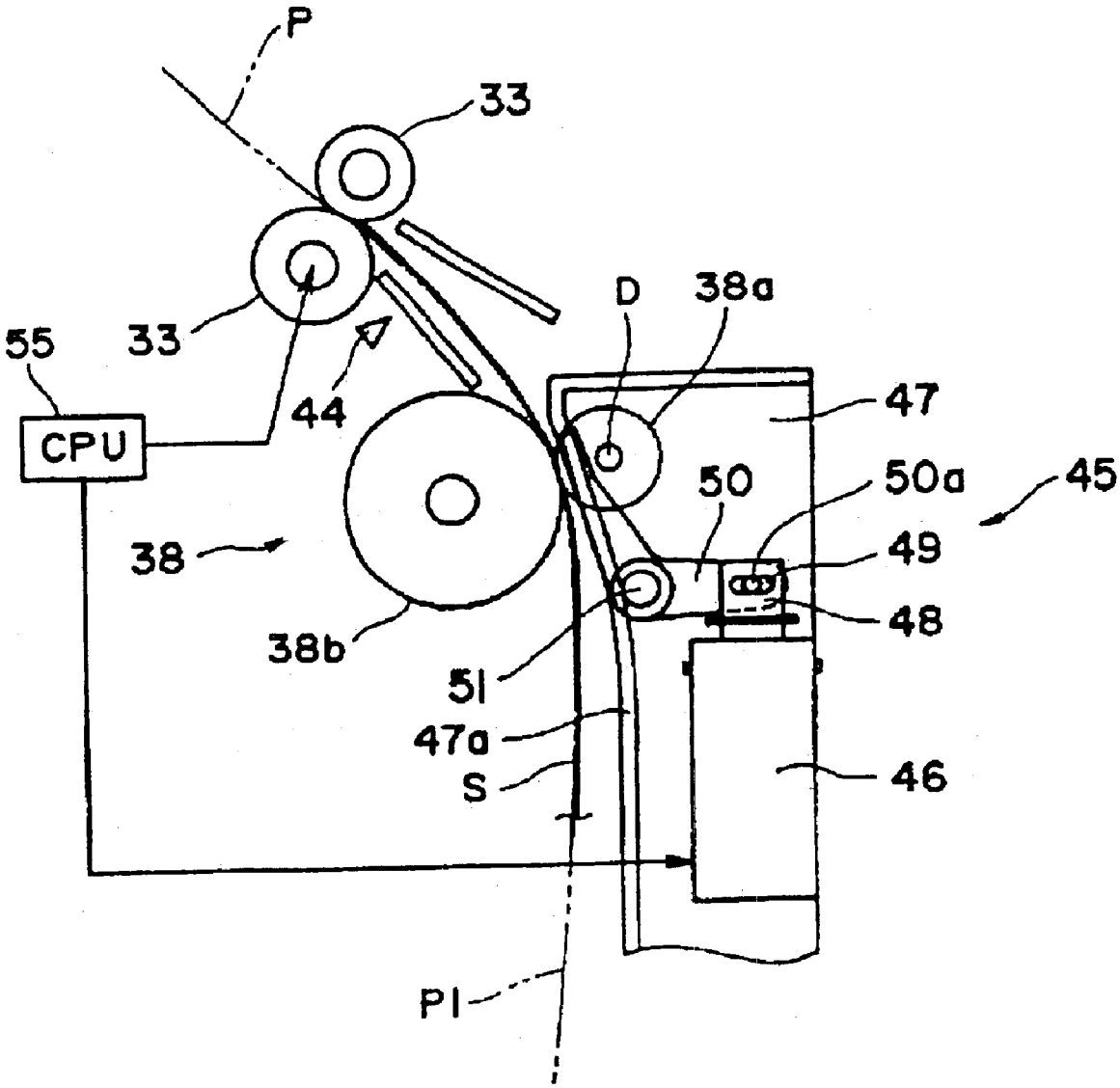
FIG. 5 is a view showing a recording medium conveying device included in the illustrative embodiment in a condition wherein nip canceling means is held in a usual position.

FIG. 5 shows a specific configuration of nip canceling means 45 included in the illustrative embodiment and configured to cancel the nip of the roller pair 38 acting on the sheet S. As shown, the nip canceling means 45 includes a solenoid or drive means 46 and an arm 50. The solenoid 46 is mounted on a bracket or support member 47 mounted on the copier body A and includes a plunger 48 formed with a slot 49. A pin 50*a* is studded on one end of the arm 50 and received in the slot 49, thereby connecting the arm 50 to the plunger 48. The other end of the arm 50 is bent upward, as viewed in FIG. 5. The arm 50 is swingably mounted on a shaft 51, which is supported by the bracket 47, at its intermediate bent portion.

The roller pair 38 is made up of a driven roller 38*a* and a drive roller 38*b*. The driven roller 38*a*, solenoid 46 that moves the driven roller 38*a* away from the drive roller 38*b* and a guide 47*a* for guiding the sheet S are mounted on the bracket 47, constituting a single unit. This facilitates mounting and dismounting of the individual structural elements. In the construction shown in FIG. 5, the bracket 47 is partly bent to form the guide plate 47*a*. The driven roller 38*a* is mounted on a shaft D adjoining the end of the arm 50 remote from the pin 50*a*.

A drive source, not shown, causes the drive roller 38*b* facing the driven roller 38*a* with the intermediary of the inlet path P1 to rotate. A spring or biasing means, not shown, constantly biases the driven roller 38*a* toward the driven roller 38*b*. The driven roller 38*a* is therefore usually held in contact with the drive roller 38*b*, as shown in FIG. 5.

When the sheet S arrives at the drive roller 38*b* and driven roller 38*a*, the rollers 38*b* and 38*a* nip the sheet S and convey it further downward by the rotation of the roller 38*b*. On abutting against the registration roller pair 33, the sheet S slackens and has its skew corrected thereby. The drive roller 38*b* is then caused to stop rotating. Subsequently, the registration roller pair 33 and roller pair 38 both are rotated in synchronism with the rotation of the drums 14M through 14K. As a result, the sheet S is conveyed toward the consecutive image transfer positions E through G while being nipped by the registration roller pair 33.

After the registration roller pair 33 has nipped the sheet S, the solenoid 46 of the nip canceling means 45 is turned on before the leading edge of the sheet S arrives at the image transfer position E, retracting its plunger 48 downward, as viewed in FIG. 5. The turn-on of the solenoid 46 may be effected in response to the output of the registration sensor 44 or a drive signal output from a CPU (Central Processing Unit) 55, which drives the registration roller pair 33. The plunger 48 so retracted pulls one end of the arm 50 for thereby causing the arm 50 to swing clockwise, as viewed in FIG. 5, about the shaft 51 against the action of the spring. Consequently, the other end of the arm 50 urges the shaft D of the driven roller 38 with the result that, as shown FIG. 6, the driven roller 38*a* is moved away from the drive roller 38*b*. This cancels the nip of the roller pair 38 acting on the sheet S. It is to be noted that the driven roller 38*a* does not have to be noticeably retracted away from the drive roller 38*b*. The crux is that the nip acting on the sheet S be canceled only to such a degree that the sheet S can become straight with its own elasticity.

Even after the nip acting on the sheet S between the drive roller 38*b* and the driven roller 38*a* has been canceled, the drive roller 38*b* should preferably be continuously rotated so as to promote the conveyance of the sheet S, which may contact the drive roller 38*b*, to the downstream side.

Figure 6:
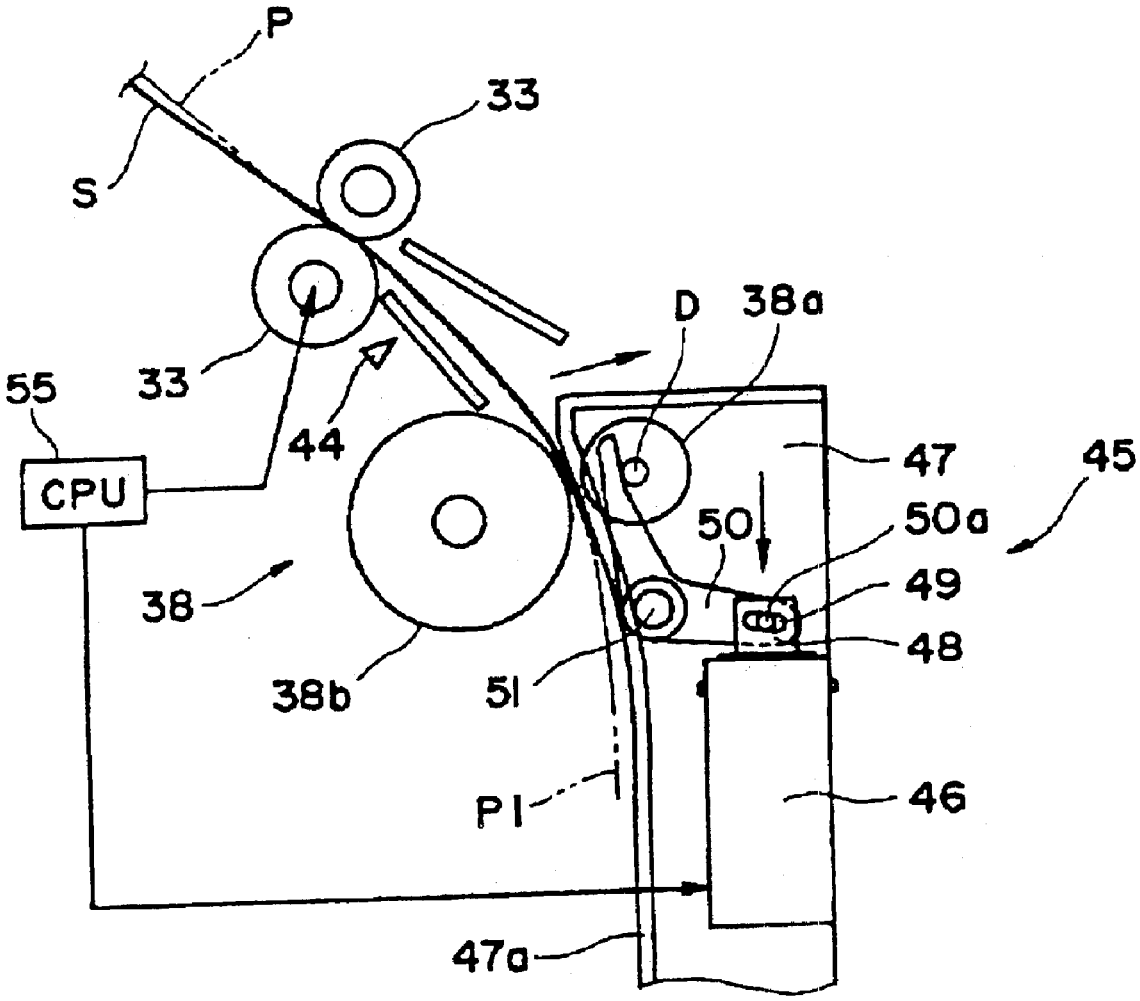
FIG. 6 is a view similar to FIG. 5, showing a condition wherein the nip canceling means has canceled the nip of a roller pair acting on a recording medium.

After the trailing edge of the sheet S has moved away from the roller pair 38, the solenoid 46 is turned off to protrude its plunger 48 upward, as viewed in FIG. 6, thereby urging one end of the arm 50. As a result, the arm 50 rotates counterclockwise about the shaft 51 while the driven roller 38*a* again contacts the drive roller 38*b* under the action of the spring, as shown in FIG. 5.

As stated above, in the illustrative embodiment, the nip canceling means 45 cancels the nip of the roller pair 38 acting on the sheet S after the skew of the sheet has been corrected by slackening. This successfully obviates the influence of stress ascribable to the slackening of the sheet S and thereby allows an image to be stably formed on the sheet S without any shift. In addition, the distance between the roller pair 38 and the registration roller pair 33 can be reduced only if the nip canceling means 45 is added, so that the number of parts is reduced to implement a compact construction.

If desired, sheet size sensing means may be associated with each of the sheet cassettes 34. In such a case, when the sheets S stacked on either one of the sheet cassettes 34 are of relatively large size, e.g., A3 or B4, the nip of a plurality of roller pairs 38 acting on the sheet S can be canceled when the registration roller pair 33 nips the sheet in accordance with the output of the sheet size sensing means. With this configuration, too, the advantages described above are achievable because a length for removing the slack of the sheet S is guaranteed despite the large size of the sheet S.

Further, the number of roller pairs 38 whose nip should be canceled may be varied in accordance with the length of the sheet S determined by the sheet size sensing means. This obviates unnecessary operation of the nip canceling means 45 and thereby saves power while obviating the influence of stress ascribable to the slackening of the sheet S.

While the drive member and driven member of the conveying member both are implemented as rollers in the illustrative embodiment, one or both of them may be implemented as belts, if desired. While the illustrative embodiment has concentrated on an image forming apparatus of the type directly transferring toner images from the drums 14M through 14K to the sheet S, the present invention is similarly applicable to an image forming apparatus of the type transferring toner images from drums to a sheet by way of an intermediate image transfer body.

In summary, it will be seen that the present invention provides a recording medium conveying device and an image forming apparatus having the following various advantages. The influence of stress ascribable to the slackening of a recording medium and therefore image shift. This frees a color image from color shift and frees a monochromatic image from, e.g., the bending of a straight line for thereby insuring high image quality. This advantage is achievable without regard to the size of the recording medium. A distance between a roller pair for conveyance and a registration roller pair can be reduced by a minimum number of parts, implementing a compact configuration.

Further, the registration roller pair can surely convey the recording medium free from skew to an image transfer position. The influence of stress ascribable to the slackening of the recording medium can be adequately obviated at correct timing. Wasteful power consumption and noise are obviated.

Various modifications will become possible for those skilled in the art after receiving the teachings of the present disclosure without departing from the scope thereof.

What is claimed is:

1. A recording medium conveying device for an image forming apparatus, comprising:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of a plurality of pairs of conveying members acting on the recording medium.

2. The device as claimed in claim 1, wherein after said registering member has nipped the recording medium, said nip canceling means cancels the nip of said conveying member.

3. The device as claimed in claim 2, wherein said nip canceling means cancels the nip of said conveying member in accordance with an output signal of a registration sensor responsive to an abutment of the recording medium against said registration member.

4. The device as claimed in claim 2, wherein said nip canceling means cancels the nip of said conveying member in accordance with a drive signal that causes said registering member to rotate for conveying the recording medium.

5. The device as claimed in claim 2, wherein said nip canceling means cancels the nip of said conveying member before a leading edge of the recording medium arrives at the image transfer position.

6. The device as claimed in claim 2, wherein said conveying member comprises a drive member and a driven member pressed against said drive member, and said nip canceling means cancels the nip of said conveying member by moving said driven member.

7. The device as claimed in claim 2, wherein said nip canceling means varies a number of said pairs of conveying members whose nip should be canceled in accordance with a length of the recording medium.

8. The device as claimed in claim 2, wherein said conveying member comprises a drive member and a driven member pressed against said drive member, and said driven member, drive means for driving said nip canceling means and a guide plate for guiding the recording medium are constructed into a unit.

9. The device as claimed in claim 2, wherein said conveying member comprises a drive member and a driven member pressed against said drive member, and, even after said nip canceling means has canceled the nip of said conveying member, said drive member is continuously rotated in a direction of conveyance.

10. The device as claimed in claim 1, wherein said conveying member comprises a drive member and a driven member pressed against said drive member, and said nip canceling means cancels the nip of said conveying member by moving said driven member.

11. The device as claimed in claim 1, wherein said nip canceling means varies a number of said pairs of conveying members whose nip should be canceled in accordance with a length of the recording medium.

12. The device as claimed in claim 1, wherein said conveying member comprises a drive member and a driven member pressed against said drive member, and said driven member, drive means for driving said nip canceling means and a guide plate for guiding the recording medium are constructed into a unit.

13. The device as claimed in claim 1, wherein said conveying member comprises a drive member and a driven member pressed against said drive member, and, even after said nip canceling means has canceled the nip of said conveying member, said drive member is continuously rotated in a direction of conveyance.

14. A recording medium conveying device for an image forming apparatus, comprising:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of said conveying member in accordance with an output signal of a registration sensor responsive to an abutment of the recording medium against said registration member.

15. A recording medium conveying device for an image forming apparatus, comprising:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium.

wherein said nip canceling means cancels the nip of said conveying member in accordance with a drive signal that causes said registering member to rotate for conveying the recording medium.

16. A recording medium conveying device for an image forming apparatus, comprising:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of said conveying member before a leading edge of the recording medium arrives at the image transfer position.

17. In an image forming apparatus comprising a recording medium conveying device, said recording medium conveying device comprises:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of a plurality of pairs of conveying members acting on the recording medium.

18. The apparatus as claimed in claim 17, wherein after said registering member has nipped the recording medium, said nip canceling means cancels the nip of said conveying member.

19. The apparatus as claimed in claim 17, wherein said conveying member comprises a drive member and a driven member pressed against said drive member, and said nip canceling means cancels the nip of said conveying member by moving said driven member.

20. The apparatus as claimed in claim 17, wherein said nip canceling means varies a number of said pairs of conveying members whose nip should be canceled in accordance with a length of the recording medium.

21. The apparatus as claimed in claim 17, wherein said conveying member comprises a drive member and a driven member pressed against said drive member, and said driven member, drive means for driving said nip canceling means and a guide plate for guiding the recording medium are constructed into a unit.

22. The apparatus as claimed in claim 17, wherein said conveying member comprises a drive member and a driven member pressed against said drive member, and, even after said nip canceling means has canceled the nip of said conveying member, said drive member is continuously rotated in a direction of conveyance.

23. In an image forming apparatus comprising a recording medium conveying device, said recording medium conveying device comprises:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of said conveying member in accordance with an output signal of a registration sensor responsive to an abutment of the recording medium against said registration member.

24. In an image forming apparatus comprising a recording medium conveying device, said recording medium conveying device comprises:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of said conveying member in accordance with a drive signal that causes said registering member to rotate for conveying the recording medium.

25. In an image forming apparatus comprising a recording medium conveying device, said recording medium conveying device comprises:

a conveying member configured to convey a recording medium by nipping said conveying medium;

a registering member configured to rotate, after the recording medium being conveyed by said conveying member has abutted against said registering member, in synchronism with a rotation of an image carrier carrying an image thereon for thereby conveying said recording medium toward an image transfer position; and nip canceling means configured to cancel, after the recording medium has slackened on abutting against said registering member, a nip of said conveying member acting on said recording medium, wherein said nip canceling means cancels the nip of said conveying member before a leading edge of the recording medium arrives at the image transfer position.

* * * * *